US011667494B2

(12) United States Patent
Kattainen et al.

(10) Patent No.: US 11,667,494 B2
(45) Date of Patent: Jun. 6, 2023

(54) MECHANISM FOR IMPROVING SAFETY FOR AN ELEVATOR SYSTEM

(71) Applicant: KONE Corporation, Helsinki (FI)

(72) Inventors: Ari Kattainen, Helsinki (FI); Antti Hovi, Helsinki (FI)

(73) Assignee: KONE CORPORATION, Helsinki (FI)

( * ) Notice: Subject to any disclaimer, the term of this patent is extended or adjusted under 35 U.S.C. 154(b) by 942 days.

(21) Appl. No.: 16/460,466

(22) Filed: Jul. 2, 2019

(65) Prior Publication Data

US 2019/0322485 A1 Oct. 24, 2019

Related U.S. Application Data

(63) Continuation of application No. PCT/EP2018/051522, filed on Jan. 23, 2018.

(30) Foreign Application Priority Data

Feb. 6, 2017 (EP) ..... 17154755

(51) Int. Cl.
*B66B 5/00* (2006.01)
*B66B 5/02* (2006.01)

(52) U.S. Cl.
CPC ..... *B66B 5/0056* (2013.01); *B66B 5/02* (2013.01)

(58) Field of Classification Search
CPC ..... B66B 5/0056; B66B 5/02; B66B 5/0068; B66B 5/005
See application file for complete search history.

(56) References Cited

U.S. PATENT DOCUMENTS 5,025,895 A * 6/1991 Leone ..... B66B 5/0031 187/390
5,347,094 A * 9/1994 Leone ..... B66B 5/0031 187/390

(Continued)

FOREIGN PATENT DOCUMENTS

CN 101084157 A 12/2007
CN 205023637 U 2/2016

(Continued)

OTHER PUBLICATIONS

JP2015074521—Machine translation (Year: 2015).*

(Continued)

*Primary Examiner* — Michael A Riegelman
(74) *Attorney, Agent, or Firm* — Birch, Stewart, Kolasch & Birch, LLP

(57) ABSTRACT

A safety control device applicable to an elevator system including an elevator car driven in an elevator shaft by means of a drive device, said safety control device comprising at least one sensor configured to detect, in the elevator shaft, a presence of an object in at least one specified area of the elevator shaft, and a controller configured to receive and process a signal of the at least one sensor indicating a detection result, and to conduct, when the detection result indicates the presence of an object in the at least one specified area of the elevator shaft, a safety procedure in which a switch from a normal drive control of the drive unit to a safety drive control is executed in which a target value set for the speed of the elevator car is decreased.

20 Claims, 7 Drawing Sheets

(56) References Cited

U.S. PATENT DOCUMENTS 5,877,462 A * 3/1999 Chenais ..... B66B 5/0031 187/382
6,050,369 A * 4/2000 Leone ..... G08B 13/19636 187/280
6,550,585 B2 * 4/2003 Schoppa ..... B66B 13/24 187/280
6,603,398 B2 * 8/2003 Tinone ..... B66B 13/22 187/390
7,201,256 B2 * 4/2007 Deplazes ..... B66B 5/0043 187/300
7,741,595 B2 * 6/2010 Lohmann ..... G01V 8/20 250/221
7,849,975 B2 * 12/2010 Ketonen ..... B66B 5/0056 187/394
7,891,467 B2 * 2/2011 Kattainen ..... B66B 5/0056 187/394
7,954,606 B2 * 6/2011 Tinone ..... B66B 5/005 187/391
8,061,486 B2 * 11/2011 Monzon ..... B66B 5/005 340/541
8,556,043 B2 * 10/2013 Mangini ..... B66B 5/0043 187/392
9,359,171 B1 * 6/2016 Nowel ..... A42B 3/0453
9,791,594 B2 * 10/2017 Eble ..... G01V 8/20
10,112,802 B2 * 10/2018 Dube ..... B66B 5/0031
10,252,882 B2 * 4/2019 Meguro ..... G08B 21/18
10,407,275 B2 * 9/2019 Khalil ..... G01B 11/22
10,983,210 B2 * 4/2021 Wos ..... B66B 5/0043
11,299,371 B2 * 4/2022 Sun ..... B66B 5/0062
2002/0117358 A1 * 8/2002 Schoppa ..... B66B 13/24 187/391
2003/0218122 A1 * 11/2003 Haberer ..... G01V 8/20 250/221
2010/0127158 A1 * 5/2010 Scheiber ..... F16P 3/144 250/208.1
2011/0094832 A1 * 4/2011 Monzon ..... B66B 5/005 187/392
2012/0018256 A1 * 1/2012 Mangini ..... B66B 5/005 250/353
2016/0145074 A1 * 5/2016 Kattainen ..... B66B 5/022 187/254
2017/0137256 A1 * 5/2017 Meguro ..... B66B 3/002
2019/0092601 A1 * 3/2019 Tegtmeier ..... B66B 5/005
2019/0094358 A1 * 3/2019 Wos ..... B66B 1/3492

FOREIGN PATENT DOCUMENTS

CN 106995169 A 8/2017
EP 1 371 596 A1 12/2003
JP 2015-74521 A 4/2015

OTHER PUBLICATIONS

European Search Report of application 17154755.7 dated Aug. 8, 2017.
International Search Report (PCT/ISA/210) issued in PCT/EP2018/051522, dated Apr. 20, 2018.
Written Opinion (PCT/ISA/237) issued in PCT/EP2018/051522, dated Apr. 20, 2018.

* cited by examiner

MECHANISM FOR IMPROVING SAFETY FOR AN ELEVATOR SYSTEM

CROSS REFERENCE TO RELATED APPLICATIONS

This application is a Continuation of PCT International Application No. PCT/EP2018/051522, filed on Jan. 23, 2018, which claims priority under 35 U.S.C. 119(a) to patent application Ser. No. 17/154,755.7, filed in the Europe on Feb. 6, 2017, all of which are hereby expressly incorporated by reference into the present application.

BACKGROUND

Field

The present invention relates to devices, methods, systems, and computer program products usable for improving safety of an elevator system when a person is located in specified areas of an elevator shaft of the elevator system, in particular in a headroom or pit space.

Background Art

The following description of background art and examples may include insights, discoveries, understandings or disclosures, or associations, together with disclosures not known to the relevant prior art, to at least some examples of embodiments of the present invention but provided by the invention. Some of such contributions of the invention may be specifically pointed out below, whereas other of such contributions of the invention will be apparent from the related context.

Elevator systems provide the possibility to access the elevator shaft, e.g. above an elevator car via a roof access of the elevator car or via an access door leading to an area above or below the elevator car, for example, the bottom are of the elevator shaft. By means of this, authorized personnel such as service technicians may enter the elevator shaft space for maintenance purposes.

However, measures have to be taken in order to ensure that that persons being in the elevator shaft are not endangered, e.g. by a movement of the elevator car.

For this purpose, several regulations and specifications are defined which are to be considered when constructing and operating an elevator. For example, safety rules for the construction and installation of lifts or elevators, such as electric elevators, hydraulic elevators, rack and pinion elevators etc, are defined in specifications like EN 80.1, EN 81-1 etc. for the European Union, or ASME (American Society of Mechanical Engineers) regulations, like A17.1 etc. for the USA. Here, requirements for elevators systems which were placed on the market are described in order to deal with significant hazards, hazardous situations and hazardous events of permanently installed new elevators (e.g. with traction, drum or positive drive) serving defined landing levels and having a car designed for the transportation of persons or persons and goods, e.g. suspended by ropes or chains and moving between guide rails. For example, dimensions required for permanent headroom and pit safety spaces for an elevator shaft are specified.

However, it is always possible that a person being located in an area of the elevator shaft, such as the permanent headroom and pit safety spaces is harmed, for example if the individual is large and hence being squeezed in the safety space of required minimum dimensions. In this context, also the speed of the elevator car arriving at the upper or lower shaft end, which is e.g. the drive speed during a normal drive control, has to be considered.

Embodiments of the present invention are related to a devices, methods, systems and computer program products, by means of which the safety situation in elevators can be improved.

SUMMARY

According to an example of an embodiment, there is provided, for example, a safety control device applicable to an elevator system including an elevator car driven in an elevator shaft by means of a drive device, said safety control device comprising at least one sensor configured to detect, in the elevator shaft, a presence of an object in at least one specified area of the elevator shaft, and a controller configured to receive and process a signal of the at least one sensor indicating a detection result, and to conduct, when the detection result indicates the presence of an object in the at least one specified area of the elevator shaft, a safety procedure in which a switch from a normal drive control of the drive unit to a safety drive control is executed in which a target value set for the speed of the elevator car is decreased.

Furthermore, according to an example of an embodiment, there is provided, for example, a safety control method applicable to an elevator system including an elevator car driven in an elevator shaft by means of a drive device, said method comprising detecting, in the elevator shaft, a presence of an object in at least one specified area of the elevator shaft, processing a detection result, and conducting, when the detection result indicates the presence of an object in the at least one specified area of the elevator shaft, a safety procedure in which a switch from a normal drive control of the drive unit to a safety drive control is executed in which a target value set for the speed of the elevator car is decreased.

According to further refinements, these examples may include one or more of the following features:

- the at least one sensor may comprise at least one of a light curtain device providing a curtain of light at an edge of the at least one specified area of the elevator shaft, the curtain of light being interrupted by an object being present in the at least one specified area, a laser scanner scanning at least a portion of the at least one specified area of the elevator shaft; a pressure detector detecting a pressure change caused by an object being located in the at least one specified area of the elevator shaft, and an electromagnetic or sound wave detector configured to emit an electromagnetic or sound wave in the at least one specified area of the elevator shaft and to detect a reflected electromagnetic or sound wave from an object being present in the at least one specified area of the elevator shaft;
- the at least one specified area of the elevator shaft may be a headroom of the elevator shaft and/or a pit safety space of the elevator shaft;
- the safety procedure to be conducted by the controller may include at least one of the following measures: changing a trigger point for executing an emergency terminal stop processing to an earlier point, limiting a target speed allowed in a normal drive control in at least one of an upward and downward direction to a predefined fraction of a nominal target speed in the normal drive control, preventing a normal drive of the elevator car and allowing only a service drive control authorized for service personal, limiting a target speed allowed in a service drive control in at least one of an upward and downward direction to a predefined fraction of a nominal target speed in the service drive control, and preventing a service drive control of the elevator car towards the specified area of the elevator shaft where the presence of the object is detected;

the measures included in the safety procedure may be selected in dependence of a position of the at least one specified area in the elevator shaft and/or the position of the elevator car in the elevator shaft;

at least one marker may be located at the elevator car in such a manner that the marker enters the at least one specified area of the elevator shaft, an operation check of the at least one sensor may be conducted by determining that the at least one marker has entered the at least one specified area of the elevator shaft, and by evaluating a detection result of the at least one sensor as to whether or not the presence of the at least one marker is detected in the at least specified area of the elevator shaft, wherein in case the presence of the at least one marker is not detected by the at least one sensor, a fault of the at least one sensor may be indicated, and in case the presence of the at least one marker is detected by the at least one sensor, it may be prohibited that the safety procedure is conducted.

In addition, according to embodiments, there is provided, for example, a computer program product for a computer, including software code portions for performing the steps of the above defined methods, when said product is run on the computer. The computer program product may include a computer-readable medium on which said software code portions are stored. Furthermore, the computer program product may be directly loadable into the internal memory of the computer or transmittable via a network by means of at least one of upload, download and push procedures.

BRIEF DESCRIPTION OF THE DRAWINGS

Some embodiments of the present invention are described below, by way of example only, with reference to the accompanying drawings, in which.

DESCRIPTION OF EMBODIMENTS

Figure 1:
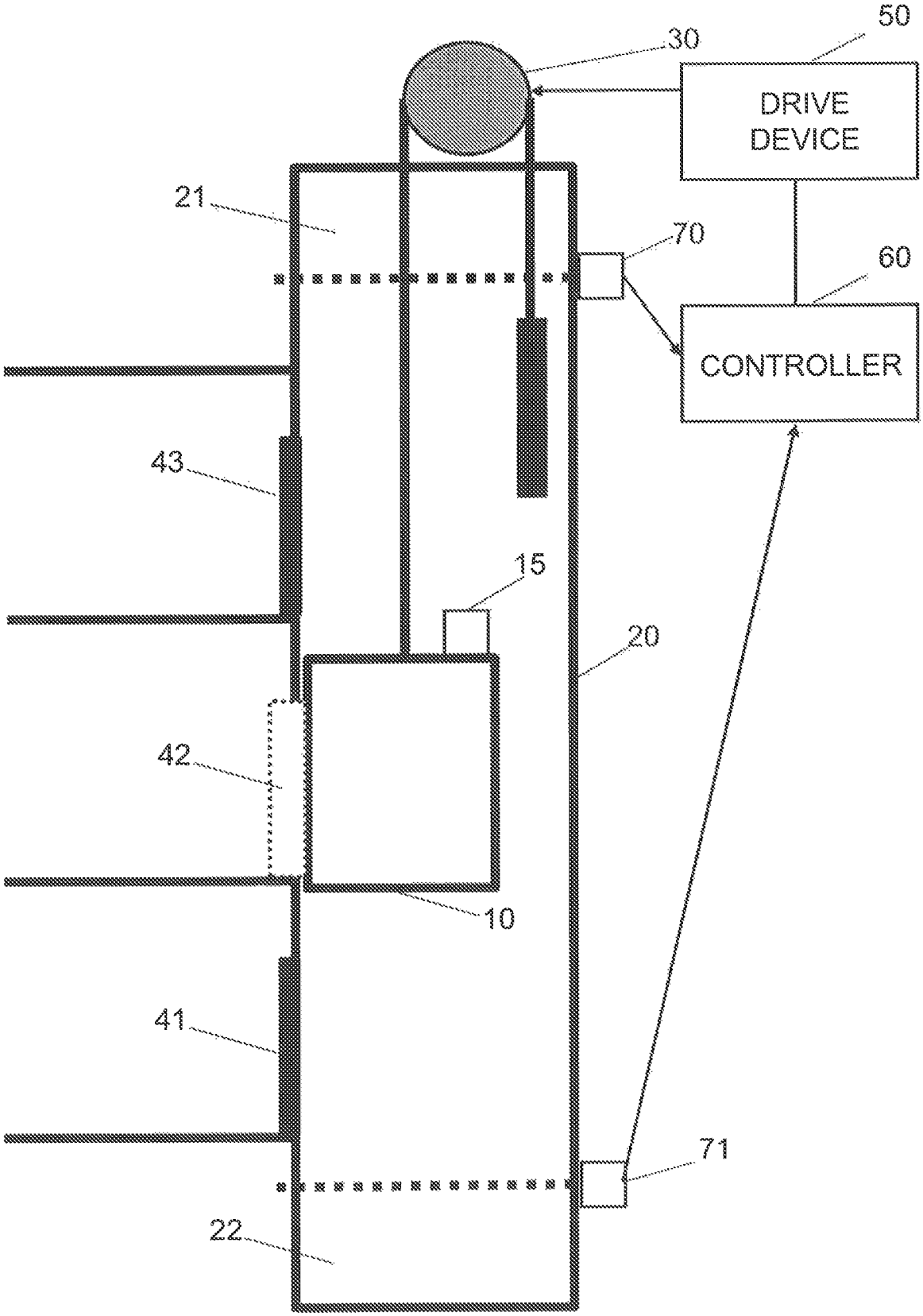
FIG. 1 shows a schematic diagram illustrating a configuration of an elevator system where some examples of embodiments are implementable.

In the following, different exemplifying embodiments will be described using, as an example of an elevator system to which the embodiments may be applied, an elevator system as depicted and explained in connection with FIG. 1. However, it is obvious for a person skilled in the art that principles of embodiments may also be applied to other kinds of elevator systems or lifts having e.g. driving units of different types, such as electric elevator systems, hydraulic elevator systems, rack and pinion elevator systems, and the like, wherein a plurality of landings (i.e. two or more floors) are reachable by one or more elevator cars in a corresponding number of elevator shafts. That is, examples of embodiments of the invention are applicable to a wide range of different kinds of elevator systems, such as traction elevators, winding elevators, hydraulic elevators, as well as to different kinds of suspension/roping configurations.

It is to be noted that the following examples and embodiments are to be understood only as illustrative examples. Although the specification may refer to "an", "one", or "some" example(s) or embodiment(s) in several locations, this does not necessarily mean that each such reference is related to the same example(s) or embodiment(s), or that the feature only applies to a single example or embodiment. Single features of different embodiments may also be combined to provide other embodiments. Furthermore, terms like "comprising" and "including" should be understood as not limiting the described embodiments to consist of only those features that have been mentioned; such examples and embodiments may also contain features, structures, units, modules etc. that have not been specifically mentioned.

The general elements and functions of described elevator systems, details of which also depend on the actual type of elevator system, are known to those skilled in the art, so that a detailed description thereof is omitted herein. However, it is to be noted that several additional devices and functions besides those described below in further detail may be employed in an elevator system.

Furthermore, elevator system elements, in particular operation elements, control elements or detection elements, as well as corresponding functions as described herein, and other elements, functions or applications may be implemented by software, e.g. by a computer program product for a computer, and/or by hardware. For executing their respective functions, correspondingly used devices, elements or functions may include several means, modules, units, components, etc. (not shown) which are required for control, processing and/or communication/signaling functionality. Such means, modules, units and components may include, for example, one or more processors or processor units including one or more processing portions for executing instructions and/or programs and/or for processing data, storage or memory units or means for storing instructions, programs and/or data, for serving as a work area of the processor or processing portion and the like (e.g. ROM, RAM, EEPROM, and the like), input or interface means for inputting data and instructions by software (e.g. floppy disc, CD-ROM, EEPROM, and the like), a user interface for providing monitor and manipulation possibilities to a user (e.g. a screen, a keyboard and the like), other interface or means for establishing links and/or connections under the control of the processor unit or portion (e.g. wired and wireless interface means etc.) and the like. It is to be noted that in the present specification processing portions should not be only considered to represent physical portions of one or more processors, but may also be considered as a logical division of the referred processing tasks performed by one or more processors.

FIG. 1 shows a schematic diagram illustrating a configuration of an elevator system where some examples of embodiments are implementable. It is to be noted that examples of embodiments are not limited to an elevator system structure with the number of levels, elevator cars and elevator shafts as shown in FIG. 1. Rather, the number of elements, functions, and structures may be different to that indicated in FIG. 1, i.e. there may be implemented or present more (or less) of the corresponding levels, elevator cars and elevator shafts than those shown in FIG. 1.

In FIG. 1, reference sign 10 denotes an elevator car containing an elevator cabin for transporting persons between the floors of a building or the like. The elevator car 10 is located and travels in a hoistway or elevator shaft 20 which ranges from the lowest floor to the highest floor and includes further spaces for accommodating, for example, devices used for driving and stopping the elevator car. Such devices comprises, without being limited thereto or being necessary in any system, for example, a moving system including e.g. a motor 30, a counterweight, guiding rails, ropes or belts, brake systems, controllers, etc., which may be installed in the elevator shaft or at the elevator car, for example. Furthermore, an elevator machinery room etc. (not shown) may be provided.

Reference sign 15 denotes an operation device for service drive control. The service drive control is used, for example by service personnel in a service drive mode for inspection or maintenance purposes, wherein the elevator car 10 can be driven by using the operation device 15 for service drive control on the car roof. It is to be noted that the operation device 15 may be also provided by service drive buttons in a maintenance access panel (not shown) outside the elevator shaft 20. The service drive control is usually allowed only for service personnel.

Reference signs 21 and 22 denote specific areas in the elevator shaft 20, i.e. a headroom and a pit safety space, whose dimensions are defined, for example, in the respective regulations related to the constructions of an elevator system. It is to be noted that even though FIG. 1 shows two specific areas 21 and 22, only one thereof may be provided (e.g. in so-called no-headroom type elevators). The headroom 21 is a space at the top end of the elevator shaft 20, while the pit safety space 22 is at the bottom end of the elevator shaft 22. These areas may be used, for example, for maintenance purposes and are usually accessible for authorized personnel only, such as service technicians.

At each floor or landing, a landing door 41, 42, 43 and 44 is provided for allowing entering or leaving the elevator cabin when the elevator car 10 has stopped at this floor. In the example illustrated in FIG. 1, it is assumed that the elevator car 10 has stopped on the second floor so that in a normal operation mode landing door 42 would be opened.

The elevator system further comprises a drive device 50 of the elevator system. The drive device 50 is connected, for example, to the motor 30, a hydraulic system and the like used for moving the elevator car 10. The drive device is used for supplying power, e.g. electric power to the motor, and modulates the power in accordance with control signals from an elevator controller for moving and stopping the elevator car 10

Reference sign 60 denotes a control element or function connected to the drive unit 50 for transmitting a control signal indicating a current drive control. For example, the control element or function (controller) 60 is a processing element like a microcomputer including a CPU (central processing unit), a memory (ROM, RAM), and an interface means for receiving and transmitting signals related to different kinds of controls for the elevator system. According to examples of embodiments of the invention, the control element or function 60 is in charge of an overall control of the elevator system, and responsible, for example, for operation of the elevator system, such as driving and braking control, power supply control, emergency control, safety procedure control, and the like. That is, drive modes being controlled include a normal drive control and a safety drive control of the elevator car 10. It is to be noted that also a plurality of dedicated control elements or functions usable for the respective drive control types may be provided.

Reference signs 70 and 71 denote a respective sensor which allows to detect whether an object (i.e. a person) is present in a specific area of the elevator shaft 10, in detail in one of the headroom and pit safety spaces 21 and 22. An output signal of the sensor 70, 71 is sent to the controller 60 by means of a suitable connection (e.g. wireless or wired connection, like a network connection).

For example, the sensor 70, 71 is a light curtain device providing a curtain of light at an edge of the specific areas 21, 22 of the elevator shaft 10. Such a light curtain is e.g. an opto-electronic device that is used to safeguard personnel in the vicinity of moving machinery with the potential to cause harm. Light curtains allow to increase the maintainability of the equipment they are guarding. For example, the light curtains are supplied as one or more pairs of a transmitter and receiver. The transmitter projects an array of parallel light beams, e.g. infrared light to the receiver which consists of a number of photoelectric cells. When an object breaks one or more of the beams, a detection signal is generate to the controller 60. For example, it is possible that the light beams emitted from the transmitter are sequenced, one after the other, and pulsed at a specific frequency. The receiver is designed to only accept the specific pulse and frequency from its dedicated transmitter. This enables the rejection of spurious infrared light and thus enhances their suitability as components within a safety system.

Also other types of sensor can be used as the sensor 70, 71, instead of the light curtain. For example, a laser scanner scanning at least a portion of the areas 21 and 22 of the elevator shaft 20 can be employed. Alternatively or additionally, a pressure detector such as a pressure mat on bottom of the elevator shaft 20 for detecting a pressure change caused by an object being located in the specific area of the elevator shaft can be employed. Furthermore, an electromagnetic or sound wave detector, such as a radar sensor or an ultrasonic detector, emitting an electromagnetic or sound wave in the specified area 21, 22 of the elevator shaft 20 and detecting a reflected electromagnetic or sound wave from an object being present in the specified area 21, 22 is employable.

The elevator system further comprises one or more operation units (not shown) which may be provided at different locations, e.g. in the elevator cabin and at each landing. Furthermore, different types of sensors may be provided in the elevator system, such as a speed sensor, a door zone sensor, and the like.

In operation, the elevator system comprises a normal terminal stopping function which automatically reduces the speed of the elevator car 10 as it approaches a terminal landing, and stop it at the terminal floor. In addition, an additional and independent emergency terminal function is provided. For example, an emergency terminal speed limiting function or emergency terminal stop (ETS) function is used which is completely independent of any other stopping or emergency-related function. Basically, the ETS function is to automatically reduce the speed of the elevator car 10 (or the counterweight) by removing power from the drive device 50 or by using a mechanical break of the elevator system. For example, the ETS function engages the machine brake if a normal deceleration is not working for some reason. In other words, the elevator car speed the terminal landings is monitored and if it is not in line with the operation setting for normal operation the ETS function acts as an emergency terminal speed limiting device. For example, when an ETS overspeed is detected, the elevator car 10 shall come to an immediate stop, wherein then movement at a reduced speed to the terminal landing may be resumed. Thus, the elevator car 10 is decelerated to a rated speed of a buffer installed in the elevator shaft 10 before impact. Usually, the ETS function is triggered by the location of the elevator car in shaft.

As indicated above, there may be situations where a person is present in an area of the elevator shaft, such as the permanent headroom and pit safety spaces. This is the case, for example, in a maintenance operation where a service control for driving the elevator car 10 is to be executed.

According to examples of embodiments of the invention, measures are provided so as to improve the safety situation in elevators in situations where a person is present in the elevator shaft, in particular in the headroom and the pit safety spaces.

Specifically, according to examples of embodiments, a safety control device or function is provided which, when the presence of an object or person is detected in specified areas of the elevator shaft, conducts a safety procedure in which a normal drive control is switched to a safety drive control in which a target value set for the speed of the elevator car is decreased.

For example, a sensor for detecting the presence of the object (person) is installed at the elevator shaft end(s), and when the sensor detects a person entering the safety space, the safety procedure is triggered so as to engage specific safety measures. For example, in the case the safety space is the headroom 21, the safety measures comprise, for example, to preventing that the speed of elevator car exceeds a fraction of a normal drive speed setting, e.g. a certain speed value like 0.3 m/s in a service drive control using e.g. the operation device 15, and/or a certain percentage of a drive speed (e.g. 30% of the nominal speed (i.e. 0.3 m/s for a 1 m/s elevator) in a normal drive control. On the other hand, in case the safety space being considered is the pit safety space, the safety measures comprises, for example, to prevent any downward movement of the elevator car 10, at least from a certain point in the elevator shaft 20, (e.g. by service drive control using the operation device 15), and/or to prevent normal drive control (i.e. stop movement of the elevator car 10), and/or to prevent a normal drive in excess of 30% of the nominal speed.

FIGS. 2 to 5 show schematic diagrams illustrating a part of the elevator system of FIG. 1 for describing the functionality of the safety control according to examples of embodiments of the invention. For explaining this functionality, FIGS. 2 to 5 comprises also one or more diagrams illustrating a drive control setting by plotting a speed target value v used for the drive control with regard to a position s of the elevator car 10 in the elevator shaft 20.

Figure 2:
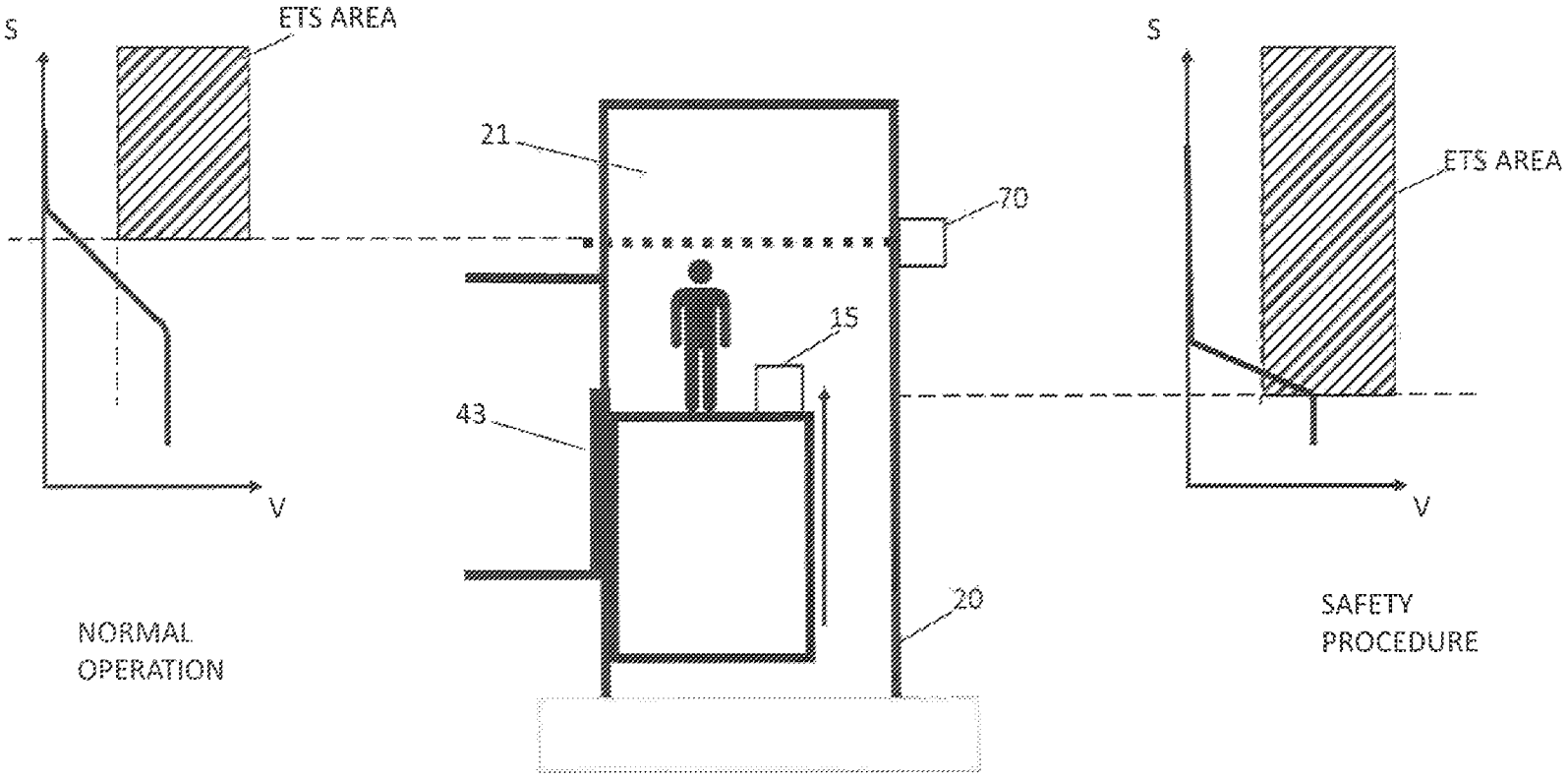
FIG. 2 shows a schematic diagram illustrating a part of the elevator system of FIG. 1 and diagrams illustrating a drive control setting according to some examples of embodiments.

Specifically, FIG. 2 shows a case where the upper end of the elevator shaft 20, i.e. the headroom 21, is considered. On the left side in FIG. 2, the drive control setting for the normal operation of the elevator is illustrated, i.e. in a case where no person is detected to be present or entering the headroom 21. Indicated by a hatched region in the diagram on the left side in FIG. 2, an ETS area is illustrated which represents the region where an ETS function would be triggered. That is, in case the elevator car 10 would be moved above a certain point in the elevator shaft with a speed being too high, so that the curve of the current speed crosses the hatched area, the ETS function would trigger the emergency terminal stop by engaging, for example, brakes for the elevator car in order to quickly reduce the speed.

As can be seen on the left side diagram, a normal operation is assumed where the speed of the elevator car 10 is controlled in such a manner that when it approaches to the uppermost landing 43, the speed is reduced in a manner that a person inside the cabin of the elevator car 10 has a comfortable impression. When the position to open the door at landing 43 is reached, the speed becomes zero. In this example, no ETS function is triggered.

On the other hand, on the right side of FIG. 2, the drive control setting for a safety procedure is illustrated, i.e. in a case where a person is detected to be present or entering the headroom 21 (e.g. by being transported upwards on the roof of the elevator car 10). When the sensor 70 detects that the person enters the headroom 21 (indicated by the dashed line), the safety procedure is executed. This is, for example, to shift the ETS area to a position being reached earlier by the elevator car 10. This is indicated in the diagram on the right side in FIG. 2. As can be seen on the right side diagram, the speed of the elevator car 10, when entering the ETS area being shifted, it too high, so that the ETS function is immediately triggered. This causes that the speed is reduced in a sharp manner so that the elevator car 10 is stopped before the person on the roof can be harmed, e.g. by hitting the ceiling of the elevator shaft. Then, a service drive control with reduced speed may be conducted by the person using the operation device 15, for example.

In other words, the safety procedure triggered by the detection result of sensor 70 causes that the ETS function is triggered not only by the location of the elevator car 10 in shaft 20, but by the fact that there is person on the roof. The point where the ETS function is triggered is hence shifted by the safety procedure. For example, the trigger point is variably shifted so that the ETS function is triggered immediately when the sensor 70 detects the entering of the person into the headroom 21, or to a preset point between the current car position and the original position where the ETS function would be triggered.

Figure 3:
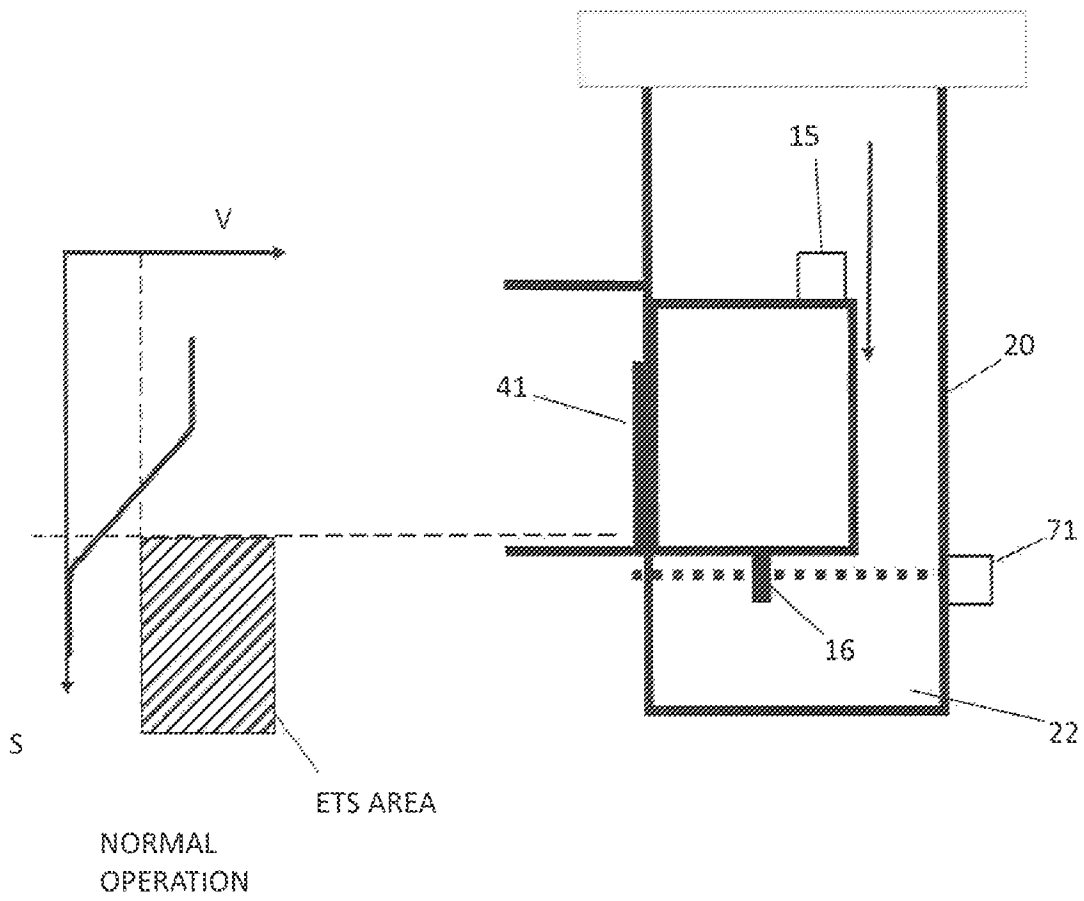
FIG. 3 shows a schematic diagram illustrating a part of the elevator system of FIG. 1 and a diagram illustrating a drive control setting according to some examples of embodiments.

FIG. 3 shows a case where the lower end of the elevator shaft 20, i.e. the pit safety space 22, is considered. On the left side in FIG. 3, the drive control setting for the normal operation of the elevator is illustrated, i.e. in a case where no person is detected to be present in the pit safety space 22. Indicated by a hatched region in the diagram on the left side in FIG. 3, an ETS area is illustrated which represents the region where the ETS function would be triggered. That is, in case the elevator car 10 would be moved below a certain point in the elevator shaft with a speed being too high, so that the curve of the current speed crosses the hatched area, the ETS function would trigger the emergency terminal stop by engaging, for example, brakes for the elevator car in order to quickly reduce the speed.

As can be seen on the left side diagram in FIG. 3, a normal operation is assumed where the speed of the elevator car 10 is controlled in such a manner that when it approaches to the landing 41, the speed is reduced in a manner that a person inside the cabin of the elevator car 10 has a comfortable impression. When the position to open the door at landing 41 is reached, the speed becomes zero. In this example, no ETS function is triggered.

Figure 4:
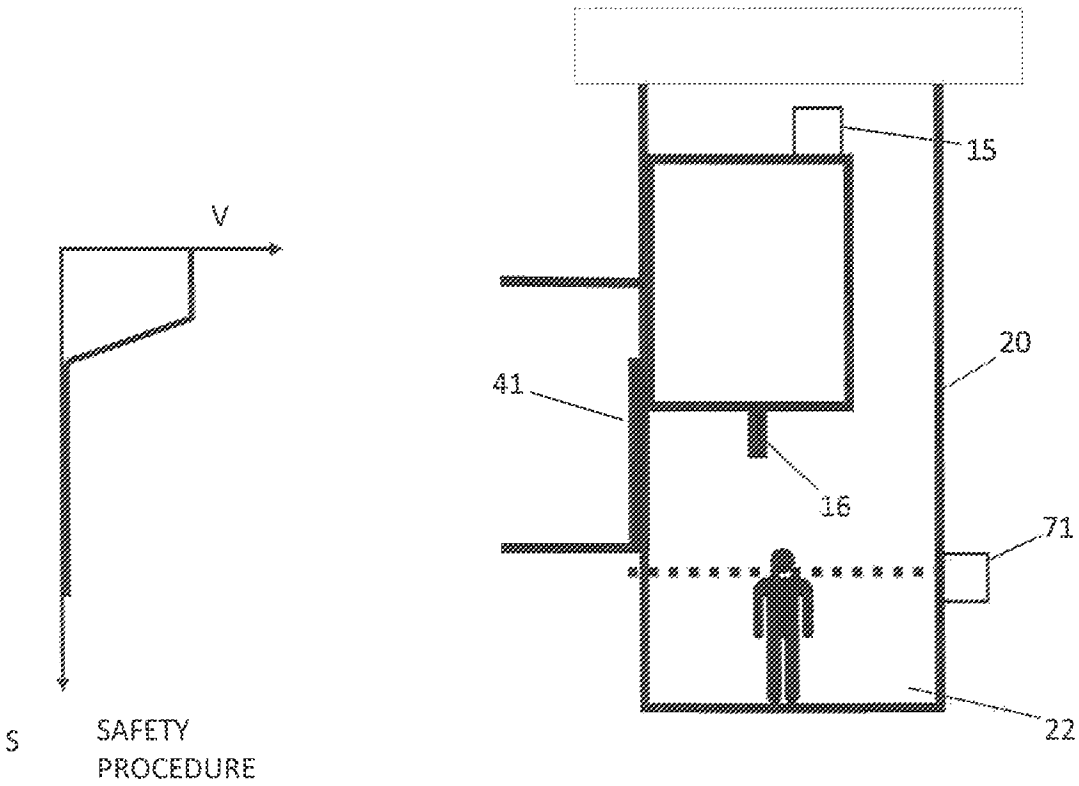
FIG. 4 shows a schematic diagram illustrating a part of the elevator system of FIG. 1 and a diagram illustrating a drive control setting according to some examples of embodiments.

On the other hand, FIG. 4 shows a case where a person is present in the pit safety space 22. On the left side in FIG. 4, the drive control setting for the safety procedure of the elevator is illustrated. According to this example, the drive control setting in the case where a person is detected to be present in the pit safety space by the sensor 71 (indicated by the dashed line) requires an immediate stop of the elevator car 10. As can be seen on the diagram in FIG. 4, the speed of the elevator car 10 is reduced to zero, e.g. as soon as the person is detected, or when the elevator car 10 is at a specific position (e.g. the landing above the lowermost landing). Then, a service drive control with reduced speed may be conducted by the person using the operation device 15, for example.

According to some further examples of embodiments, correct operation of the sensors 70 and 71 is checked in order to ensure that the safety control is functional. For example, correct operation of sensors 70 and 71 is checked in such a manner that a detection range (e.g. position of a light curtain) in the elevator shaft 20 is set in such way that the elevator car enters the detection range at the very end of every drive to the corresponding terminal landing (e.g. the uppermost terminal landing 43 in case of sensor 70 or the lowermost terminal landing 41 in case of sensor 71). The sensor detects then the elevator car as an object entering the respective specified area, but the safety controller expects to get a detection signal from the sensor at the end of every such drive, e.g. by determining the elevator car position by means of other measures (door open signal, car position sensor, and the like).

Consequently, it the sensor outputs a detection signal, the controller is aware of the fact that no person caused this signal but the elevator car. Hence, the correct functionality of the sensor is confirmed, while execution of a safety procedure which would be caused by a sensor signal output is prohibited. On the other hand, in case the sensor output is not received by the controller in this situation, a fault of the sensor can be determined. Then, for example, a flag or the like indicating the sensor fault is set.

Figure 5:
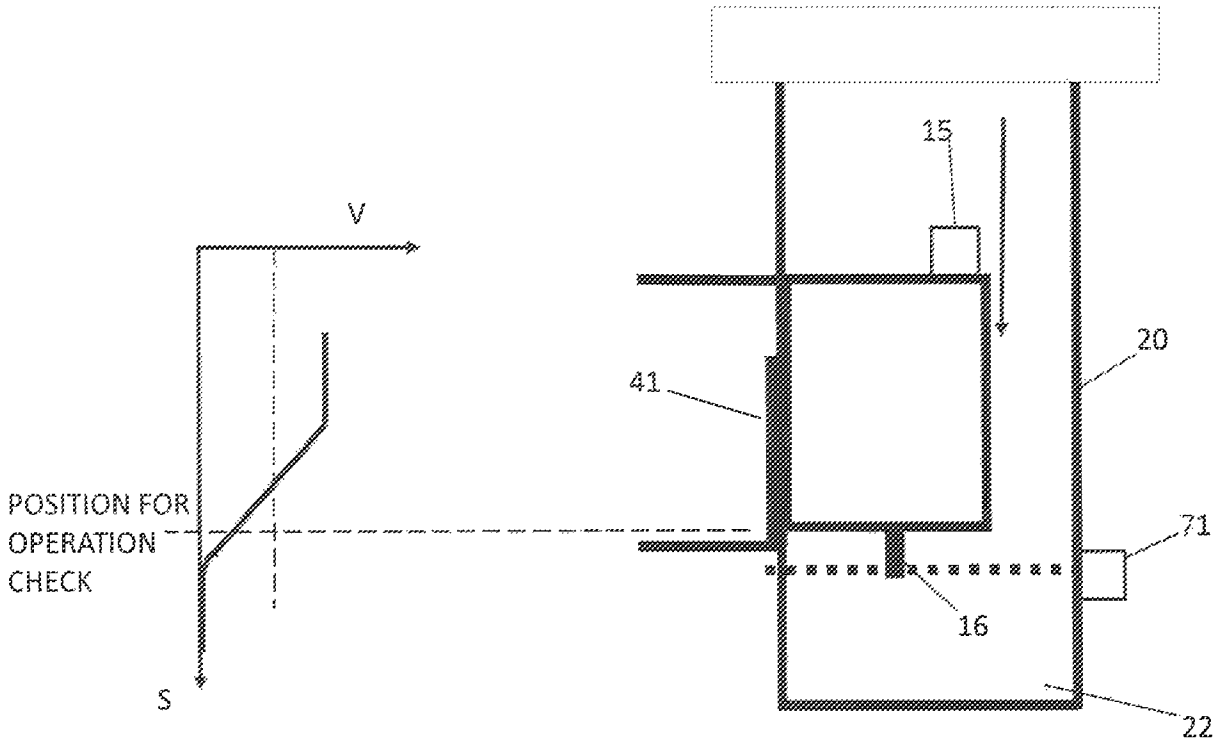
FIG. 5 shows a schematic diagram illustrating a part of the elevator system of FIG. 1 and a diagram illustrating a drive control setting according to some examples of embodiments.

In other words, the operation check of the sensor is done by using one or more markers (such as the elevator car 10 itself or a dedicate marker means attached to the elevator car 10, like a marker 16 indicated in FIGS. 3 to 5). When the marker causes the sensor to output a detection result, it is recognized that this is not caused by a person in the headroom 20 or the pit safety space 21, so that the safety controller does not engage the safety measures. For example, a operation check mode may be set where the safety measures are overridden during a normal drive at a normal speed, while only the signal coming from the sensor is monitored. Alternatively, a certain position of the elevator car is determined as a start position of the operation check, i.e. when the elevator car reaches this position, any signal from the sensor is seen to be used only for operation check but not for triggering the safety procedure.

FIG. 5 shows such an operation check procedure. Specifically, a case is shown where the lower end of the elevator shaft 20, i.e. the pit safety space 22, is considered. On the left side in FIG. 3, the drive control setting of the elevator is illustrated. When the elevator car 10 reaches the position for the operation check, the controller recognizes this and expects that the marker 16 is detected by the sensor 71 and causes a corresponding detection signal. When the elevator car 10 moves below the position for operation check, the normal drive control is continued, even if the sensor signal is received. When the position to open the door at landing 41 is reached, the speed becomes zero. Hence, no ETS function or the like is triggered. When no signal is received, the sensor 71 is determined to be faulty.

It is to be noted that according to some examples of embodiments of the invention, alternatives for determining the operation check condition can be implemented. For example, in the example described in connection with FIG. 5, the position of the elevator car 10 is used as a reference for determining that the output of the sensor is not to be used as a trigger for the safety procedure. Alternatively or additionally, the form of the detection result can be used as a reference for determining as to whether or not the operation check is executed, i.e. as to whether or not the safety procedure is to be triggered. For example, the marker 16 may be formed in such a manner that a specific detection result is achieved by the sensor when it is detected in the specified area. This can be achieved, for example, by a specific form or number of markers 16, or by specific reflection properties (color, radar signature or the like) allowing to discriminate the detection result for the marker from the detection result of another object, including a person, present in the specified areas 20 and 21. This allows, for example, to improve the accuracy of the determination that actually no person is detected, even if the operation check is conducted.

Figure 6:
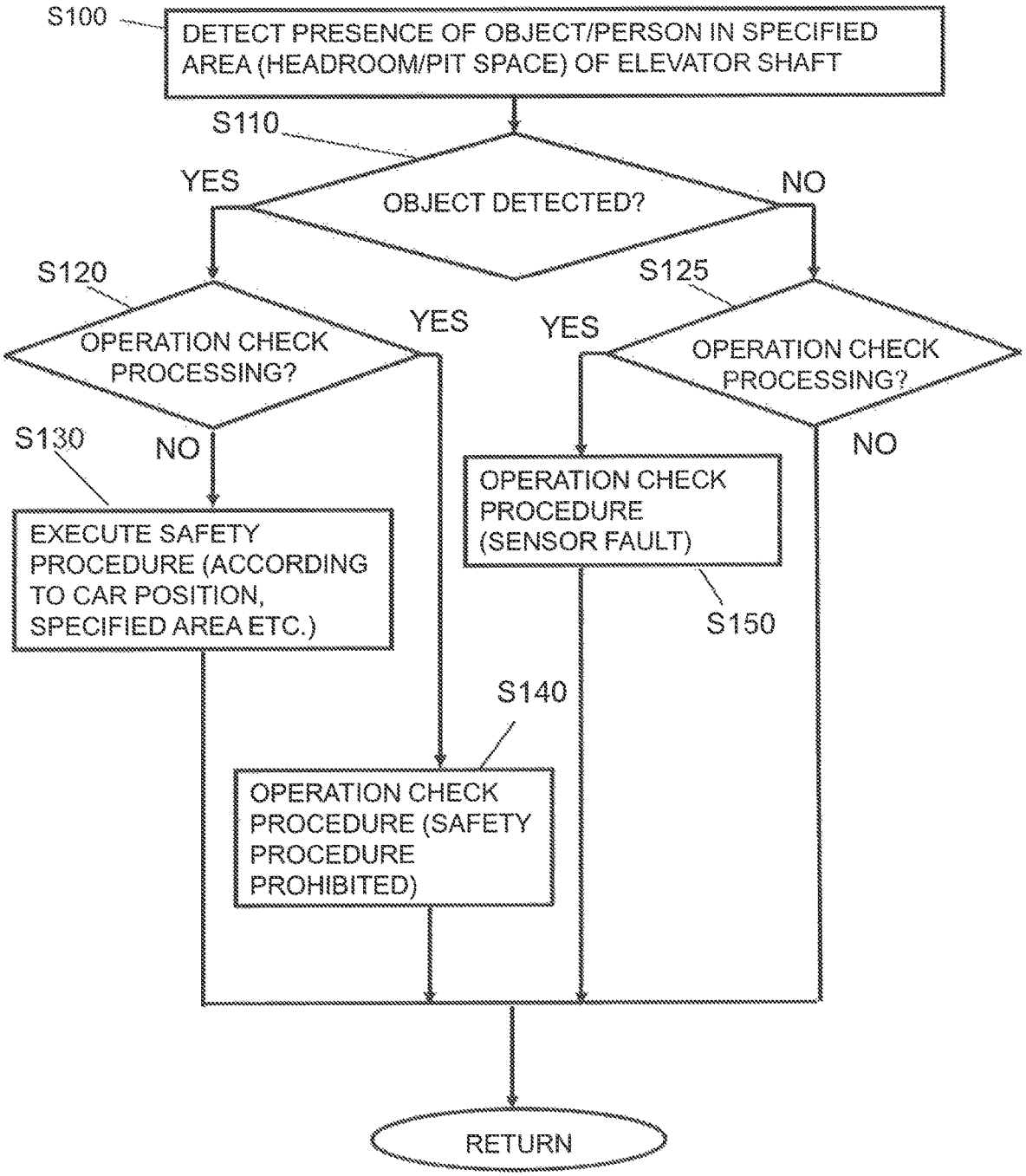
FIG. 6 shows a flow chart of a safety control according processing to some examples of embodiments.

FIG. 6 shows a flow chart of a safety control processing conducted in an elevator system according to some examples of embodiments. Specifically, the example according to FIG. 6 is related to a procedure conducted by the controller 60 of FIG. 1, for example.

In S100, it is detected whether or not an object, in particular a person, is present in at least one specified area of an elevator shaft. According to examples of embodiments, the at least one specified area of the elevator shaft is a headroom of the elevator shaft and/or a pit safety space of the elevator shaft. Furthermore, according to examples of embodiments, the presence of the object in the at least one specified area of the elevator shaft is detected by a suitable sensor, which comprises, for example, at least one of a light curtain device providing a curtain of light at an edge of the at least one specified area of the elevator shaft, the curtain of light being interrupted by an object being present in the at least one specified area, a laser scanner scanning at least a portion of the at least one specified area of the elevator shaft; a pressure detector detecting a pressure change caused by an object being located in the at least one specified area of the elevator shaft, and an electromagnetic or sound wave detector configured to emit an electromagnetic or sound wave in the at least one specified area of the elevator shaft and to detect a reflected electromagnetic or sound wave from an object being present in the at least one specified area of the elevator shaft.

In S110, the detection result of S100 is processed in order to evaluate the presence of an object. In case the detection result indicates the presence of an object in the at least one specified area of the elevator shaft, the processing proceeds to S120. Otherwise, in case no object is detected in the specified area of the elevator shaft, the processing proceeds to S125.

In S120, it is determined whether an operation check processing is to be conducted. For example, it is determined whether the detected object is a marker (or the elevator car), wherein also the elevator car position may be considered in order to determine whether the detection result is to be assumed as representing a detection of the marker or elevator car.

In case the result of the determination in S120 is negative, i.e. the detection result is not to be considered as a detection of the marker (or the elevator car) at the end of the movement of the elevator car (in other word, an object or person is actually present in the specified area), a safety procedure is executed in S130. For example, according to some examples of embodiments, the safety procedure switches the drive control mode from a normal drive control of the drive unit to a safety drive control in which a target value set for the speed of the elevator car is decreased. Specifically, according to examples of embodiments, the safety procedure to be conducted includes at least one of the following measures: changing a trigger point for executing an emergency terminal stop processing to an earlier point, limiting a target speed allowed in a normal drive control in at least one of an upward and downward direction to a predefined fraction of a nominal target speed in the normal drive control, preventing a normal drive of the elevator car and allowing only a service drive control authorized for service personal, limiting a target speed allowed in a service drive control in at least one of an upward and downward direction to a predefined fraction of a nominal target speed in the service drive control, and preventing a service drive control of the elevator car towards the specified area of the elevator shaft where the presence of the object is detected. It is to be noted that according to some examples of embodiments, the measures included in the safety procedure are selected in dependence of a position of the at least one specified area in the elevator shaft (e.g. measures for the headroom region may be different to that of the pit safety space region) and/or the position of the elevator car in the elevator shaft. For example, when the elevator car is far away from the specified area where the object is detected, the measures for safety procedure may be less restricting or even suspended, while in case the elevator car is closer to the respective specified area, more restrictive measures may be taken. As an illustrative example, it may be possible to configure the safety procedure such that, in case the object is detected in the pit safety space, the safety procedure is started not before the elevator car is in the lower third of the elevator shaft.

Otherwise, in case the determination in S120 is positive, i.e. the detected objected is assumed to be the marker (or the elevator car) entering the specified area of the elevator shaft, in S140 an operation check processing is conducted (for example, since the elevator car position is at a corresponding position in the shaft), wherein an execution of the safety procedure is prohibited.

On the other hand, in case the determination in S110 is negative, i.e. no object is detected, the processing proceeds to S125.

In S125, it is determined whether an operation check processing is conducted. Here, it is determined whether the elevator car is at a position where it has to be expected that at this point of time an object is detected (for example, an object like a marker or the elevator car). That is, the operation check processing is conducted, for example, on the basis of the elevator car position used as a reference in order to determine that an operation check processing is valid where detection result should have been achieved.

In case the result of the determination in S125 is positive, i.e. an operation check processing is valid, the processing proceeds to S150 where, since there is no detection result even though one should have been obtained, the operation check procedure is completed by indicating a fault in the detection of the object in the at least specified area of the elevator shaft (i.e. a corresponding sensor fault is indicated, e.g. by setting a flag or the like).

Otherwise, in case the operation check processing is not valid (e.g. since the elevator car is away from the position where the marker or elevator car should have been detected) (NO in S125), since no detection result is present, the processing in this cycle is ended.

It is to be noted that the processing according to S120 and S125 can be also omitted or executed only at specific timings. In other words, the processing related to the operation check of the sensors is not mandatory in each processing cycle. In this case, it is only determined in S110 whether an object is detected, and if this is the case (YES in S110), the processing proceeds directly to S130 (execution of the safety procedure). Otherwise, the current processing cycle is ended.

Figure 7:
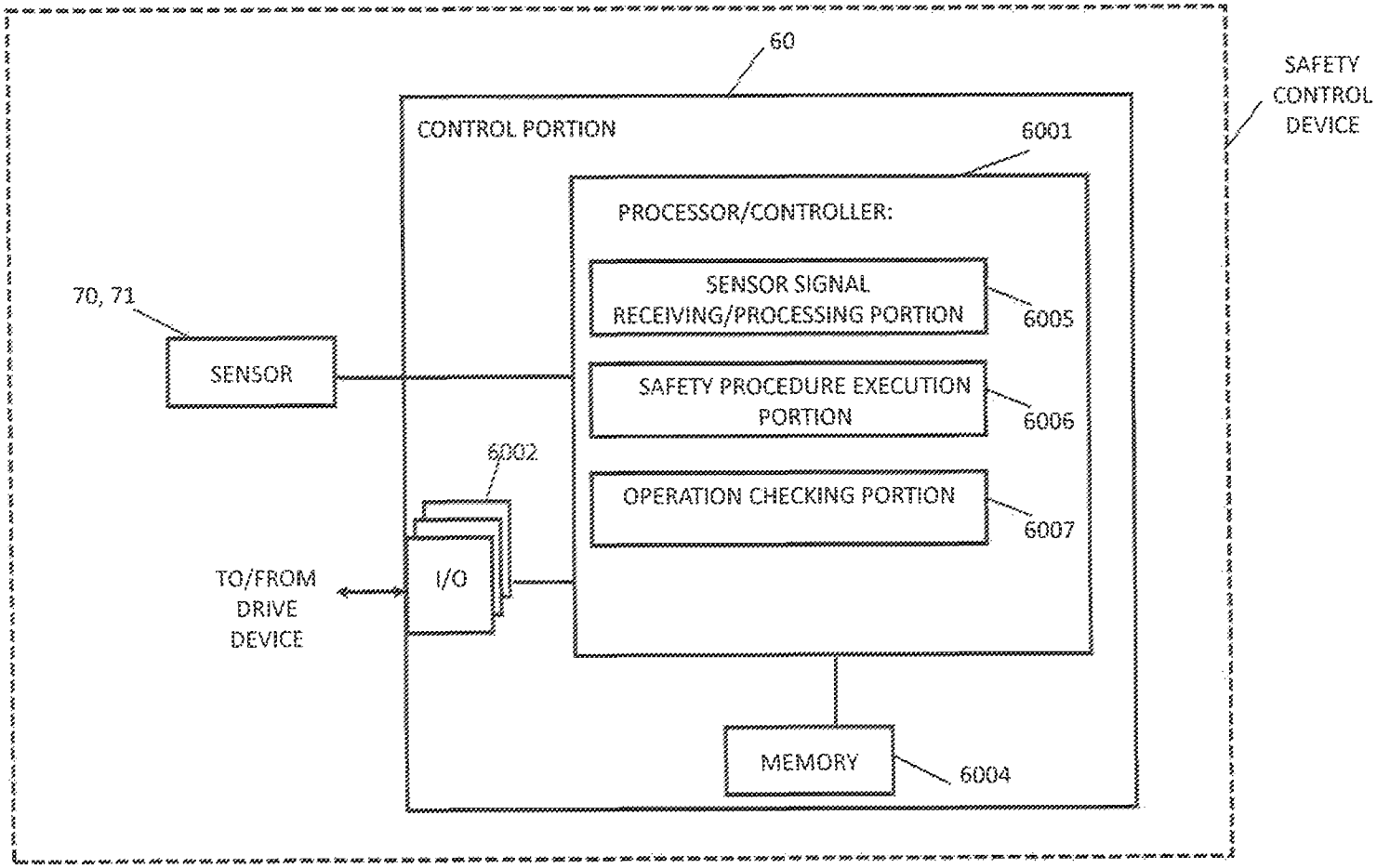
FIG. 7 shows a diagram of a configuration of a safety control device according to some examples of embodiments.

FIG. 7 shows a diagram of a configuration of a safety control device according to some examples of embodiments, which is configured to implement a safety control procedure for an elevator system as described in connection with some of the examples of embodiments. It is to be noted that the safety control device shown in FIG. 7 comprises elements or functions corresponding to the sensor 70, 71 and the control portion 60 of FIG. 1, but it may include further elements or functions besides those described herein below. Furthermore, even though reference is made to a device like a control portion, a sensor, and the like, the safety control device or function may comprise also another device or function having a similar task, such as a chipset, a chip, a module, an application etc., which can also be part of a controller or attached as a separate device to a controller, or the like. It should be understood that each block and any combination thereof may be implemented by various means or their combinations, such as hardware, software, firmware, one or more processors and/or circuitry.

The safety device shown in FIG. 7 may include in the control portion 60 a processing circuitry, a processing function, a control unit or a processor 6001, such as a CPU or the like, which is suitable for executing instructions given by programs or the like related to the control procedure. The processor 6001 may include one or more processing portions or functions dedicated to specific processing as described below, or the processing may be run in a single processor or processing function. Portions for executing such specific processing may be also provided as discrete elements or within one or more further processors, processing functions or processing portions, such as in one physical processor like a CPU or in one or more physical or virtual entities, for example. Reference sign 6002 denotes input/output (I/O) units or functions (interfaces) connected to the processor or processing function 6001. The I/O units 6002 may be used for communicating with the other elements or function as described in connection with FIG. 1, for example, the sensor drive device 50, sensors and the like. The I/O units 6002 may be a combined unit including interface or communication equipment towards several elements, or may include a distributed structure with a plurality of different interfaces for different elements. Furthermore, the processor 6001 is also connected to the sensor 70, 71. Reference sign 6004 denotes a memory usable, for example, for storing data and programs to be executed by the processor or processing function 6001 and/or as a working storage of the processor or processing function 6001. It is to be noted that the memory 6004 may be implemented by using one or more memory portions of the same or different type of memory.

The processor or processing function 6001 is configured to execute processing related to the above described safety procedures. In particular, the processor or processing circuitry or function 6001 includes one or more of the following sub-portions. Sub-portion 6005 is a processing portion which is usable as a portion for receiving and processing a sensor signal. The portion 6005 may be configured to perform processing according to S100 of FIG. 6. Furthermore, the processor or processing circuitry or function 6001 may include a sub-portion 6006 usable as a portion for executing the safety procedure. The portion 6006 may be configured to perform a processing according to S130 of FIG. 6. In addition, the processor or processing circuitry or function 6001 may include a sub-portion 6007 usable as a portion for conducting an operation checking procedure. The portion 6007 may be configured to perform a processing according to S120, S125, S140 and S150 of FIG. 6.

In addition, according to another example of embodiments, there is provided safety control device comprising at least one processing circuitry, and at least one memory for storing instructions to be executed by the processing circuitry, wherein the at least one memory and the instructions are configured to, with the at least one processing circuitry, cause the device at least: to be applicable to an elevator system including an elevator car driven in an elevator shaft by means of a drive device, to comprise at least one sensor function configured to detect, in the elevator shaft, a presence of an object in at least one specified area of the elevator shaft, and to receive and process a signal of the at least one sensor function indicating a detection result, and to conduct, when the detection result indicates the presence of an object in the at least one specified area of the elevator shaft, a safety procedure in which a switch from a normal drive control of the drive unit to a safety drive control is executed in which a target value set for the speed of the elevator car is decreased.

Furthermore, according to some other examples of embodiments, in the above defined device, the at least one memory and the instructions may be further configured to, with the at least one processing circuitry, cause the device to conduct at least one of the processing defined in the above described methods, for example a method according that described in connection with FIG. 6.

As described above, according to some examples of embodiments, procedures allowing to improve safety of an elevator system are provided, in which specified areas in the elevator shaft are provided where a person could be harmed by the movement of the elevator car. That is, specified areas in the elevator shaft, such as the shaft end safety spaces, can be monitored in a reliable manner.

The proposed measures can be used in combination with other methods for ensuring service personnel safety in the elevator shaft, so that a flexible safety configuration is possible.

Furthermore, it is possible to check and monitor the operation of relevant parts of the safety device, in particular of the employed sensors, in a reliable manner without the necessity to use complex test equipment. In this context, it is also possible to use cheaper components for the sensors than those rated for safety purposes.

Moreover, examples of embodiments are easy to implement. For example, already installed elevator systems can be modified, e.g. by software update, to allow application of the invention.

While the above described examples of embodiments are related to a headroom and/or a pit safety space as the specified areas of the elevator shaft, the present invention is not limited thereto. It is also possible to monitor other areas in the elevator shaft besides these rooms, for example a site at a side wall of the elevator shaft, if required.

It should be appreciated that embodiments suitable to be implemented as software code or portions of it and being run using a processor or processing function are software code independent and can be specified using any known or future developed programming language, such as a high-level programming language, such as objective-C, C, C++, C#, Java, Python, Javascript, other scripting languages etc., or a low-level programming language, such as a machine language, or an assembler.

implementation of embodiments is hardware independent and may be implemented using any known or future developed hardware technology or any hybrids of these, such as a microprocessor or CPU (Central Processing Unit), MOS (Metal Oxide Semiconductor), CMOS (Complementary MOS), BiMOS (Bipolar MOS), BiCMOS (Bipolar CMOS), ECL (Emitter Coupled Logic), and/or TTL (Transistor-Transistor Logic).

embodiments may be implemented as individual devices, apparatuses, units, means or functions, or in a distributed fashion, for example, one or more processors or processing functions may be used or shared in the processing, or one or more processing sections or processing portions may be used and shared in the processing, wherein one physical processor or more than one physical processor may be used for implementing one or more processing portions dedicated to specific processing as described, a device may be implemented by a semiconductor chip, a chipset, or a (hardware) module including such chip or chipset;

embodiments may also be implemented as any combination of hardware and software, such as ASIC (Application Specific IC (Integrated Circuit)) components, FPGA (Field-programmable Gate Arrays) or CPLD (Complex Programmable Logic Device) components or DSP (Digital Signal Processor) components.

embodiments may also be implemented as computer program products, including a computer usable medium having a computer readable program code embodied therein, the computer readable program code adapted to execute a process as described in embodiments, wherein the computer usable medium may be a non-transitory medium.

Although the present invention has been described herein before with reference to particular embodiments thereof, the present invention is not limited thereto and various modifications can be made thereto.

The invention claimed is:

1. A safety control device applicable to an elevator system including an elevator car driven in an elevator shaft by a drive device, said safety control device comprising:

at least one sensor configured to detect, in the elevator shaft, a presence of an object in at least one specified area of the elevator shaft; and a controller configured to receive and process a signal of the at least one sensor indicating a detection result, and to conduct, when the detection result indicates the presence of an object in the at least one specified area of the elevator shaft, a safety procedure in which a switch from a normal drive control of the drive device to a safety drive control is executed in which a target value set for the speed of the elevator car is decreased, wherein the at least one specified area of the elevator shaft is a headroom of the elevator shaft and/or a pit safety space of the elevator shaft, wherein the safety procedure to be conducted by the controller includes at least one of:

limiting a target value set for the speed of the elevator car during the safety drive control in at least one of an upward and downward direction to a predefined fraction of a nominal target speed set in the normal drive control, the target value being greater than zero; and limiting a target value set for the speed of the elevator car during the safety drive control in at least one of an upward and downward direction to a predefined fraction of a nominal target speed set in a service drive control authorized for service personnel, the target value being greater than zero, wherein the safety control device further includes at least one marker located at the elevator car in such a manner that the marker enters the at least one specified area of the elevator shaft, and wherein the controller is further configured to conduct an operation check of the at least one sensor by determining that the at least one marker has entered the at least one specified area of the elevator shaft, and by evaluating a detection result of the at least one sensor as to whether or not the presence of the at least one marker is detected in the at least one specified area of the elevator shaft.

2. The safety control device according to claim 1, wherein the at least one sensor comprises at least one of:

a light curtain device providing a curtain of light at an edge of the at least one specified area of the elevator shaft, the curtain of light being interrupted by an object being present in the at least one specified area;

a laser scanner scanning at least a portion of the at least one specified area of the elevator shaft;

a pressure detector detecting a pressure change caused by an object being located in the at least one specified area of the elevator shaft; and an electromagnetic or sound wave detector configured to emit an electromagnetic or sound wave in the at least one specified area of the elevator shaft and to detect a reflected electromagnetic or sound wave from an object being present in the at least one specified area of the elevator shaft.

3. The safety control device according to claim 2, wherein the safety procedure to be conducted by the controller includes at least one of the following measures:

changing a trigger point for executing an emergency terminal stop processing to an earlier point;

preventing a normal drive of the elevator car and allowing only the service drive control authorized for service personal; and preventing the service drive control of the elevator car towards the specified area of the elevator shaft where the presence of the object is detected.

4. The safety control device according to claim 2, further comprising:

wherein, in case the presence of the at least one marker is not detected by the at least one sensor, the controller is configured to indicate a fault of the at least one sensor, and wherein, in case the presence of the at least one marker is detected by the at least one sensor, the controller is configured to prohibit that the safety procedure is conducted.

5. The safety control device according to claim 1, wherein the safety procedure to be conducted by the controller includes at least one of the following measures:

changing a trigger point for executing an emergency terminal stop processing to an earlier point;

preventing a normal drive of the elevator car and allowing only the service drive control authorized for service personal; and preventing the service drive control of the elevator car towards the specified area of the elevator shaft where the presence of the object is detected.

6. The safety control device according to claim 5, wherein the measures included in the safety procedure are selected in dependence of a position of the at least one specified area in the elevator shaft and/or the position of the elevator car in the elevator shaft.

7. The safety control device according to claim 5, wherein, in case the presence of the at least one marker is not detected by the at least one sensor, the controller is configured to indicate a fault of the at least one sensor, and wherein, in case the presence of the at least one marker is detected by the at least one sensor, the controller is configured to prohibit that the safety procedure is conducted.

8. The safety control device according to claim 1, wherein the measures included in the safety procedure are selected in dependence of a position of the at least one specified area in the elevator shaft and/or the position of the elevator car in the elevator shaft.

9. The safety control device according to claim 8, wherein, in case the presence of the at least one marker is not detected by the at least one sensor, the controller is configured to indicate a fault of the at least one sensor, and wherein, in case the presence of the at least one marker is detected by the at least one sensor, the controller is configured to prohibit that the safety procedure is conducted.

10. A safety control device applicable to an elevator system including an elevator car driven in an elevator shaft by a drive device, said safety control device comprising:

at least one sensor configured to detect, in the elevator shaft, a presence of an object in at least one specified area of the elevator shaft; and a controller configured to receive and process a signal of the at least one sensor indicating a detection result, and to conduct, when the detection result indicates the presence of an object in the at least one specified area of the elevator shaft, a safety procedure in which a switch from a normal drive control of the drive device to a safety drive control is executed in which a target value set for the speed of the elevator car is decreased, wherein the at least one specified area of the elevator shaft is a headroom of the elevator shaft and/or a pit safety space of the elevator shaft, wherein the safety procedure to be conducted by the controller includes at least one of:

limiting a target value set for the speed of the elevator car during the safety drive control in at least one of an upward and downward direction to a predefined fraction of a nominal target speed set in the normal drive control; and limiting a target value set for the speed of the elevator car during the safety drive control in at least one of an upward and downward direction to a predefined fraction of a nominal target speed set in a service drive control authorized for service personnel, wherein the safety control device further includes at least one marker located at the elevator car in such a manner that the marker enters the at least one specified area of the elevator shaft, wherein the controller is further configured to conduct an operation check of the at least one sensor by determining that the at least one marker has entered the at least one specified area of the elevator shaft, and by evaluating a detection result of the at least one sensor as to whether or not the presence of the at least one marker is detected in the at least one specified area of the elevator shaft, wherein, in case the presence of the at least one marker is not detected by the at least one sensor, the controller is configured to indicate a fault of the at least one sensor, and wherein, in case the presence of the at least one marker is detected by the at least one sensor, the controller is configured to prohibit that the safety procedure is conducted.

11. A safety control method applicable to an elevator system including an elevator car driven in an elevator shaft by a drive device, said method comprising:

detecting, in the elevator shaft, a presence of an object in at least one specified area of the elevator shaft;

processing a detection result; and conducting, when the detection result indicates the presence of an object in the at least one specified area of the elevator shaft, a safety procedure in which a switch from a normal drive control of the drive device to a safety drive control is executed in which a target value set for the speed of the elevator car is decreased, wherein the at least one specified area of the elevator shaft is a headroom of the elevator shaft and/or a pit safety space of the elevator shaft, wherein the safety procedure to be conducted includes at least one of limiting a target value set for the speed of the elevator car during the safety drive control in at least one of an upward and downward direction to a predefined fraction of a nominal target speed set in the normal drive control, the target value being greater than zero, and limiting a target value set for the speed of the elevator car during the safety drive control in at least one of an upward and downward direction to a predefined fraction of a nominal target speed set in a service drive control authorized for service personnel, the target value being greater than zero, and wherein the method further comprises:

providing at least one marker at the elevator car in such a manner that the marker enters the at least one specified area of the elevator shaft; and conducting an operation check by determining that the at least one marker has entered the at least one specified area of the elevator shaft, and by evaluating a detection result of the at least one sensor as to whether or not the presence of the at least one marker is detected in the at least specified area of the elevator shaft.

12. The safety control method according to claim 11, wherein the presence of the object in the at least one specified area of the elevator shaft is detected by at least one sensor comprising at least one of:

a light curtain device providing a curtain of light at an edge of the at least one specified area of the elevator shaft, the curtain of light being interrupted by an object being present in the at least one specified area;

a laser scanner scanning at least a portion of the at least one specified area of the elevator shaft;

a pressure detector detecting a pressure change caused by an object being located in the at least one specified area of the elevator shaft; and an electromagnetic or sound wave detector configured to emit an electromagnetic or sound wave in the at least one specified area of the elevator shaft and to detect a reflected electromagnetic or sound wave from an object being present in the at least one specified area of the elevator shaft.

13. The safety control method according to claim 12, wherein the safety procedure to be conducted includes at least one of the following measures:

changing a trigger point for executing an emergency terminal stop processing to an earlier point;

preventing a normal drive of the elevator car and allowing only the service drive control authorized for service personal; and preventing the service drive control of the elevator car towards the specified area of the elevator shaft where the presence of the object is detected.

14. The safety control method according to claim 12, further comprising:

indicating, in case the presence of the at least one marker is not detected, a fault of the detection of the object in the at least specified area of the elevator shaft; and prohibiting, in case the presence of the at least one marker is detected, that the safety procedure is conducted.

15. The safety control method according to claim 11, wherein the safety procedure to be conducted includes at least one of the following measures:

changing a trigger point for executing an emergency terminal stop processing to an earlier point;

preventing a normal drive of the elevator car and allowing only the service drive control authorized for service personal; and preventing the service drive control of the elevator car towards the specified area of the elevator shaft where the presence of the object is detected.

16. The safety control method according to claim 15, further comprising:

selecting the measures included in the safety procedure in dependence of a position of the at least one specified area in the elevator shaft and/or the position of the elevator car in the elevator shaft.

17. The safety control method according to claim 11, further comprising:

selecting the measures included in the safety procedure in dependence of a position of the at least one specified area in the elevator shaft and/or the position of the elevator car in the elevator shaft.

18. The safety control method according to claim 11, further comprising:

indicating, in case the presence of the at least one marker is not detected, a fault of the detection of the object in the at least specified area of the elevator shaft; and prohibiting, in case the presence of the at least one marker is detected, that the safety procedure is conducted.

19. A computer program product for a computer, including software code portions for performing the steps of claim 11 when said product is run on the computer.

20. The computer program product according to claim 19, wherein the computer program product includes a computer-readable medium on which said software code portions are stored, and/or the computer program product is directly loadable into the internal memory of the computer or transmittable via a network by means of at least one of upload, download and push procedures.

* * * * *